US005231741A

United States Patent [19]

Maguire

[11] Patent Number: 5,231,741

[45] Date of Patent: Aug. 3, 1993

[54] ARTICULATED BED FOR POSITIONING HUMAN BODIES IN CASKETS

[75] Inventor: Keith D. Maguire, Batesville, Ind.

[73] Assignee: Batesville Casket Company, Inc., Batesville, Ind.

[21] Appl. No.: 791,561

[22] Filed: Nov. 12, 1991

[51] Int. Cl.[5] ..... A61G 17/04

[52] U.S. Cl. ..... 27/12; 5/612; 5/618

[58] Field of Search ..... 27/12; 5/612-618

[56] References Cited

U.S. PATENT DOCUMENTS

| | | | |
|---|---|---|---|
| 543,974 | 3/1895 | Zwack | 27/12 |
| 621,407 | 3/1899 | Gerwe | 27/12 |
| 629,275 | 7/1899 | Scribner | 5/612 |
| 647,959 | 4/1900 | Gerwe | 27/12 |
| 965,641 | 7/1910 | Lynch . | |
| 1,661,377 | 3/1928 | Lutz . | |
| 1,840,675 | 1/1932 | Letzig . | |
| 1,934,435 | 11/1933 | Harms . | |
| 2,051,163 | 8/1936 | Corrigan | 27/12 |
| 2,099,977 | 11/1987 | Harris . | |
| 2,670,517 | 3/1954 | Gukkebbrabd et al. . | |
| 2,735,157 | 2/1956 | Hotchkiss et al. . | |
| 4,044,436 | 8/1977 | Patrick . | |
| 4,403,380 | 9/1983 | Hazelett . | |
| 4,621,395 | 11/1986 | Benoit . | |
| 4,873,731 | 10/1989 | Williamson | 5/618 X |
| 4,993,129 | 2/1991 | Underwood et al. . | |

*Primary Examiner*—Richard E. Chilcot, Jr.
*Attorney, Agent, or Firm*—Wood, Herron & Evans

[57] ABSTRACT

In a casket, a rigid bed frame is adjustably mounted at its end so that the casket bed frame can be raised, lowered and tilted. Mounted on the rigid bed frame is an adjustable body support positioned at about the thoracic area for raising the chest and lifting the chin off the chest. It is contemplated that the adjustable device has a pair of hinged frames with a power transmission mechanism for sliding one edge of the frame to pivot the hinged edges of the frame of the bed. Alternatively, an inflatable bladder underlies the body and is used to raise it, or is positioned between a pair of hinged members and causes the upper hinged member to raise the body. Two pairs of hinged members may be positioned across the width of the bed frame underlying the body, and the upper hinged member of each pair may be raised to different heights thereby allowing the thoracic area of the body to be rotated about a longitudinal axis of the bed frame.

13 Claims, 6 Drawing Sheets

ARTICULATED BED FOR POSITIONING HUMAN BODIES IN CASKETS

BACKGROUND OF THE INVENTION

This invention relates to a casket bed frame, and more particularly, to a casket bed having provision for raising the thoracic area of the human body.

Bed frames of various types and kinds are in use now in caskets and have been for many years. The bed frame is used to support the human body and is used in conjunction with pillows and mattresses. In the past, numerous kinds of hinged beds, separate supporting structures and other devices have been used to obtain various positioning effects of the deceased. These devices seek to produce a "natural" or serene look for the deceased during viewing and memorial services, etc In particular, with today's "softer" embalming techniques, there is a tendency for the deceased's chin to be forced down into the chest producing an unwanted unnatural position. This effect has for many years been handled by stuffing various materials, such as cotton wadding, newspaper, empty bottles and boxes, beneath the thoracic area of the body the object being to raise the thoracic area, thereby lifting the chin and achieving the desired natural look and serene appearance.

Prior art describes beds that are hinged at various locations relative to the human anatomy and various methods and means of adjusting these positions. However, these devices suffer a number of disadvantages. When the body support surface is hinged, the horizontal plane of the bed as a baseline is lost and positioning is somewhat awkward.

SUMMARY OF THE INVENTION

The present invention does not require or rely on hinging the bed. In accordance with the present invention, the horizontal plane of the bed and its support function remain planar with the adjustment mechanism contained within and reacting upon a rigid bed frame. Furthermore, the structure of the invention is able to incorporate at the same time other bed movement functions that are beneficial in use but very difficult, if not impossible, with hinged and other prior art devices. Thus, the present invention can accommodate a vertical movement of the planar bed independently of the head and foot end, and it can concomitantly allow independent tilting of the planar bed at the head end and raise and lower the thoracic area and the lumbar area (if so desired). These features and functions are far beyond the prior art versatility and function.

The objective of the present invention ha been to provide a bed frame having the capability of adjusting the thoracic area of a body while at the same time maintaining the capability of raising, lowering and tilting the whole bed frame.

This objective is achieved by providing a rigid bed frame and mounting on the rigid bed frame a vertically movable support located at the thoracic area of the body to be supported in the casket.

In one form of the invention, the adjustable support consists of two frames hinged together along adjacent edges. The other edge of one frame is pivoted to the rigid bed frame and the edge of the other frame is slidable with respect to the rigid bed frame. A power transmission mechanism, operable from one end of the bed frame, slides the slidable edge to cause the hinged edges of the frames to rise. The power transmission mechanism includes a splined vertical shaft with either a sprocket or a mitered gear slidably but non-rotatably mounted on the splined shaft. The slidable mounting permits the bed frame to move vertically while the sprocket or mitered gear slides on the splined shaft. The sprocket on the splined shaft is used in conjunction with a sprocket on the bed frame and an endless chain. The chain is connected to an actuating rod which moves the slidable edge of the frame. The miter gear on the splined shaft meshes with a similar gear which is fitted onto one end of the actuating rod, the other end of the actuating rod being threaded through an acme nut which is connected to the slidable edge of the frame.

In an alternative form of the invention, an elongated inflatable bladder is transversely mounted across the bed frame, preferably being sewn inside a mattress. The inflating of the bladder causes the thoracic area of the human body to rise. It can also be located to raise the lumbar area of the body.

In another alternative embodiment of the invention, an inflatable bladder is placed between a set of hinged plates mounted across the bed frame. Inflating the bladder causes the uppermost hinged plate to rise causing the thoracic area of the deceased to rise.

In yet another alternative form of the invention, an inflatable bladder is placed between each of two sets of hinged plates mounted across the bed frame. Inflating the bladders causes the uppermost hinged plates to rise causing the thoracic area of the deceased to rise. In addition, the uppermost hinged plates can be raised to differing heights, thereby providing for rotation of the thoracic area of the deceased about a longitudinal axis of the bed frame.

BRIEF DESCRIPTION OF THE DRAWINGS

The several features of the invention will become more readily apparent from the following detailed description taken in conjunction with the accompanying drawings in which.

DESCRIPTION OF THE PREFERRED EMBODIMENTS

Figure 1:
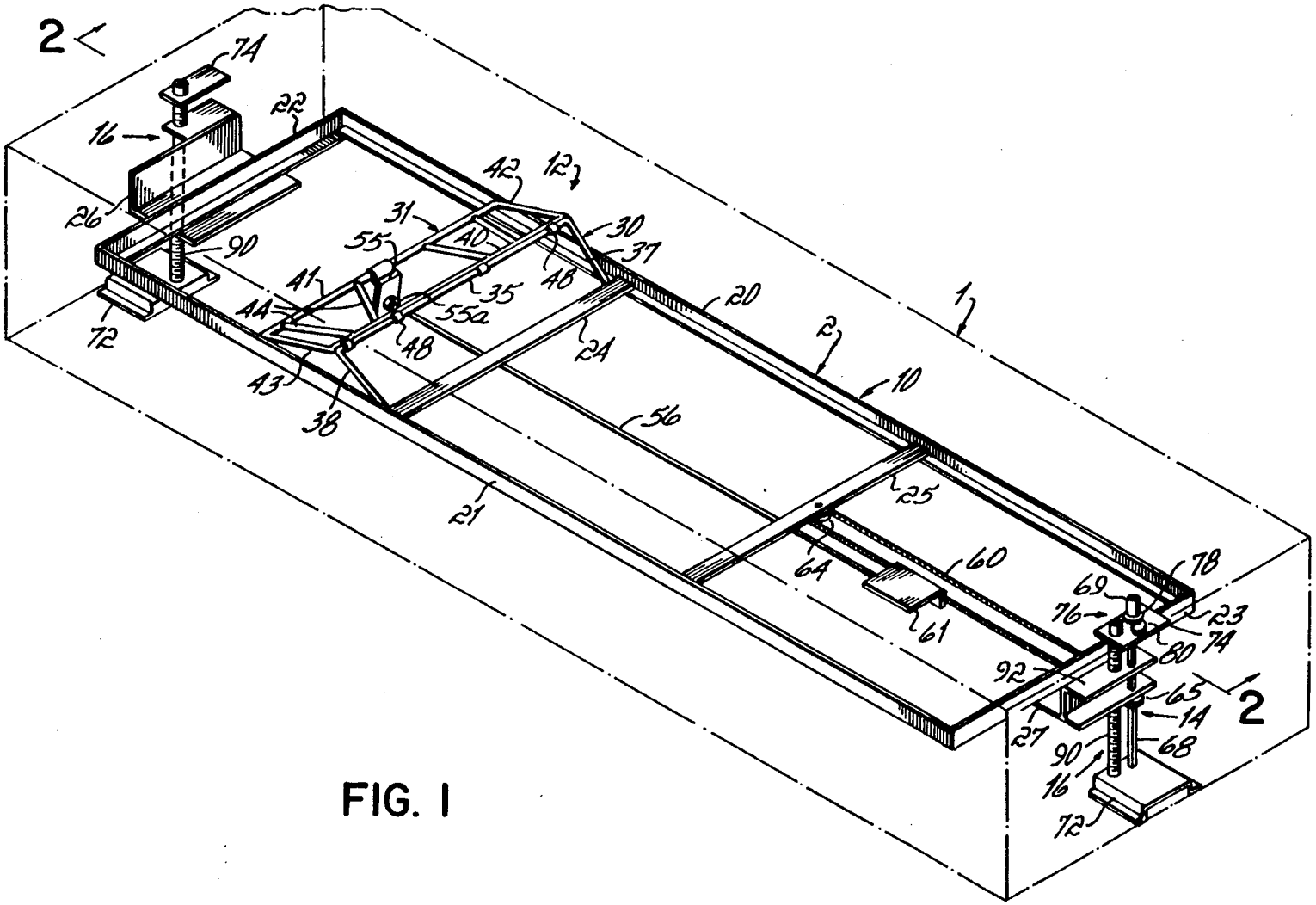
FIG. 1 is a perspective view of a casket bed frame including the adjustable thoracic lift frame of the present invention.
Figure 2:
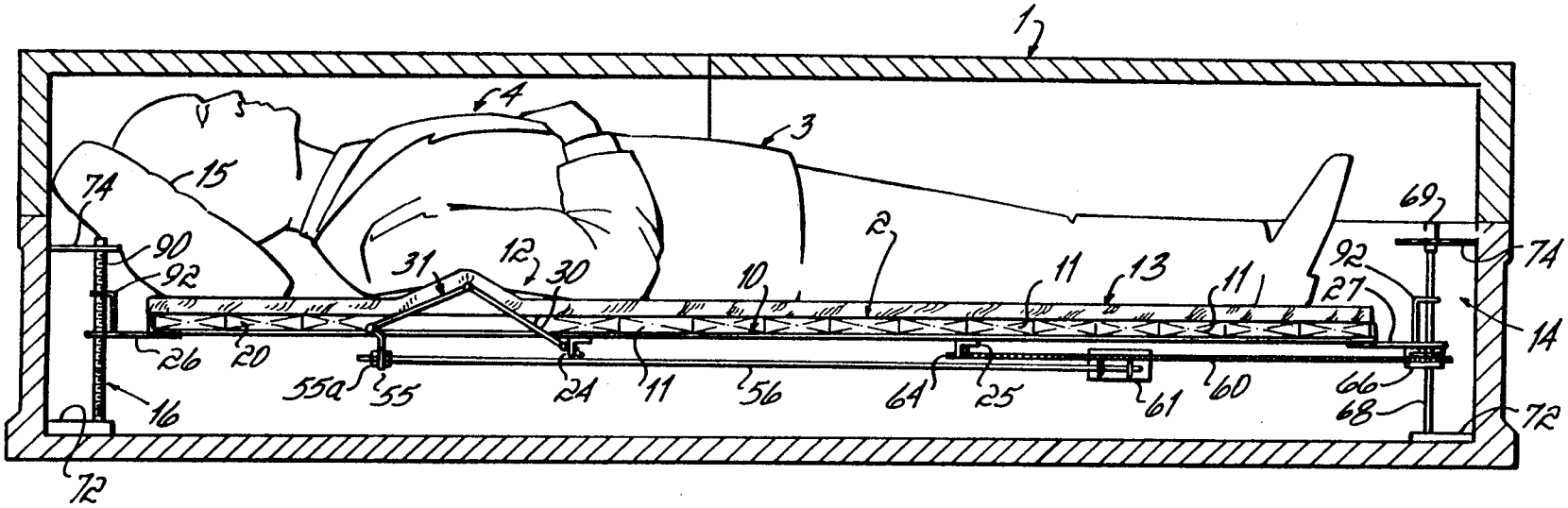
FIG. 2 is a view taken along lines 2—2 of FIG. 1 and illustrating the lifting action on the thoracic area of the deceased.
Figure 9:
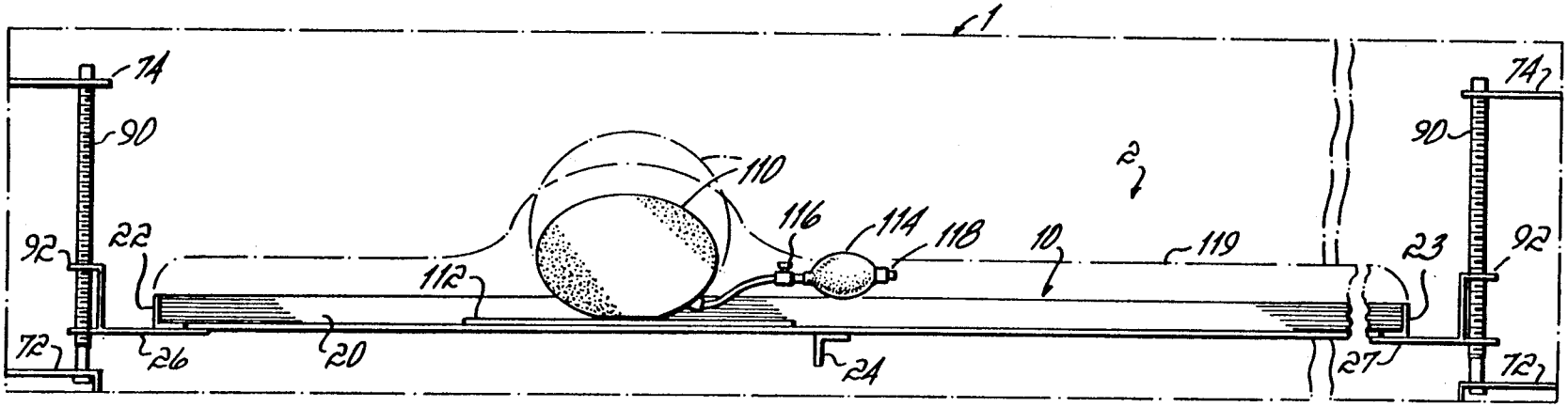
FIG. 9 is a view similar to FIG. 6 but illustrating another alternative embodiment of the present invention.

With reference first to FIGS. 1-5, and in particular FIGS. 1 and 2, there is illustrated a casket shell 1 incorporating a bed frame assembly 2 of the present invention for supporting a corpse or deceased 3 thereon. While various spring assemblies, mattresses, pillows, fabric treatments and the like are conventionally employed in the use of casket shells and bed frames, with the exception of FIGS. 2 and 9 such have not been shown for clarity purposes.

The bed frame assembly 2 includes a bed frame 10, a thoracic lift frame assembly 12 for engaging the back of corps 3 to raise its thoracic area 4 and to produce a more natural and serene appearance, a lift frame operating mechanism 14, and a pair of bed frame lift drive assemblies 16 for raising and lowering the bed frame 10. Within the bed frame 10 there are placed bed springs 11 upon which is placed a mattress 13 and pillow 15.

The bed frame 10 includes sides or angles 20 and 21, ends 22 and 23, and transverse supports 24 and 25. Bed frame members 20-25 may be any suitable structural members, as for example structural angles. Bed support brackets 26 and 27 are secured to bed frame ends 22 and 23, respectively, and secure the bed frame 10 to each bed frame lift drive assembly 16 as will be described in more detail subsequently.

Figure 3:
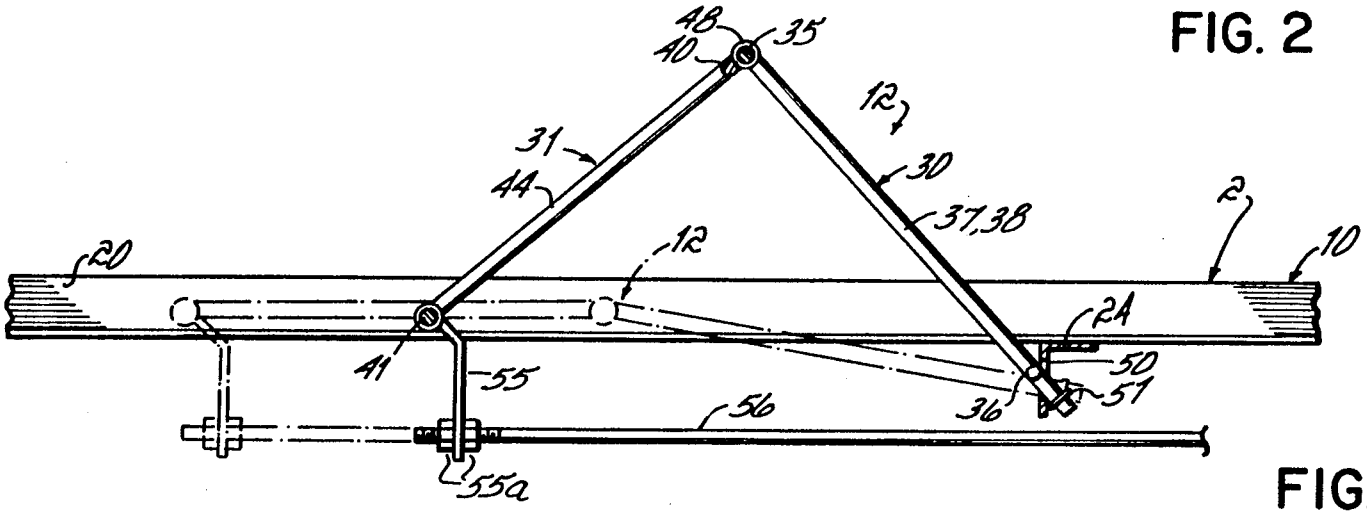
FIG. 3 is an enlarged side elevational view of the adjustable lift frame of FIGS. 1 and 2.

With reference to FIGS. 1 and 3, there is illustrated the novel thoracic lift frame assembly 12 of the present invention. The lift frame assembly 12 comprises lift frames 30 and 31. Lift frame 30 includes edges 35 and 36 and ends 37 and 38. Lift frame 31 includes edges 40 and 41, ends 42 and 43, and transverse supports 44. Lift frames 30 and 31 are hingedly connected at their abutting edges 35 and 40, respectively, with hinges 48.

Figure 6:
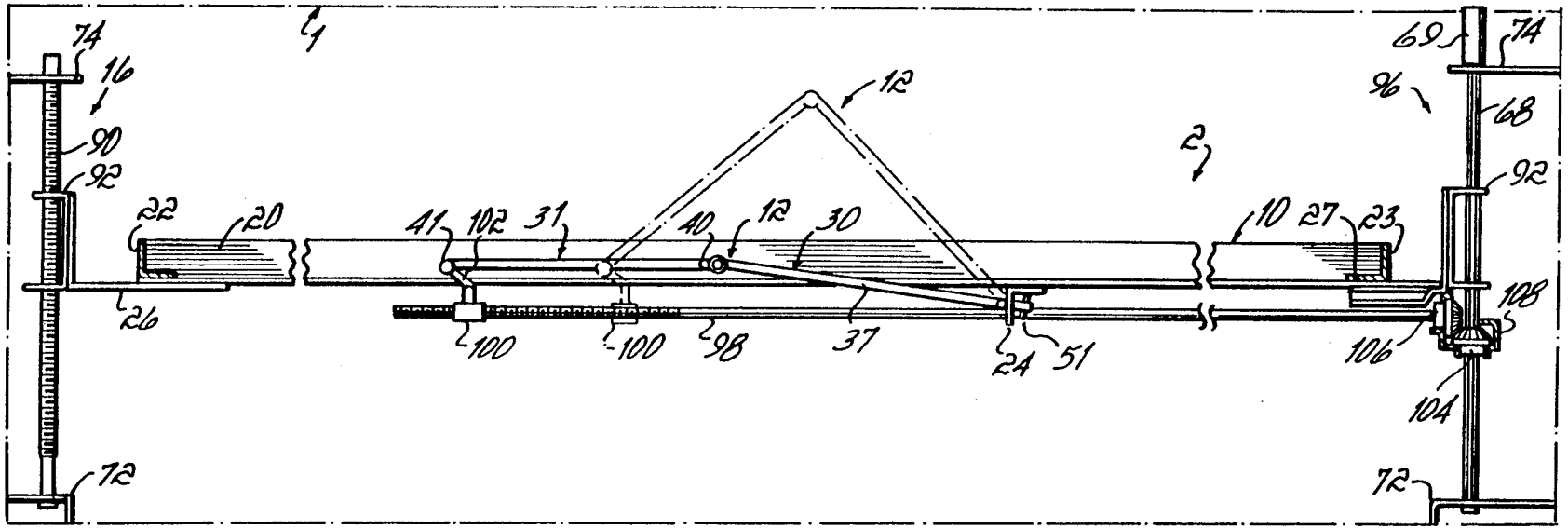
FIG. 6 is a view similar to FIG. 2 but illustrating an alternative embodiment of the present invention.

With reference to FIGS. 3 and 6, it will be seen that the ends 37 and 38 of lift frame 30 extend past edges 35 and 36 through slots 50 in the transverse support 24. The ends 37 and 38 of frame 30 have shoulders 51 thereon which serve as keepers to retain the ends 37 and 38 through the slots 50. Slots 50 are of sufficient dimension to allow lift frame 30 to pivot freely (FIG. 3). With reference to FIGS. 1 and 3, it will be seen that slidable edge 41 of frame 31 is slidable on the angles 20 and 21 of bed frame 10.

A bracket 55 is secured to edge 41 of lift frame 31. An actuator rod 56 having a threaded end is connected to the bracket 55 with nuts 55*a* and, upon operation of the lift frame operating mechanism 14, which will be subsequently described, causes the hinged edges 35 and 40 of the lift frame assembly 12 to be raised or lowered as desired. In a preferred embodiment, the lift frames 30 and 31 are approximately 7" wide and when raised by actuator rod 56 produce a vertical lift of approximately 4¼"-5". However, the range of lift can be from 0" to 8" by proper selection of lift frame width and horizontal displacement of slidable edge 41 of frame 31.

Figures 4, 5:
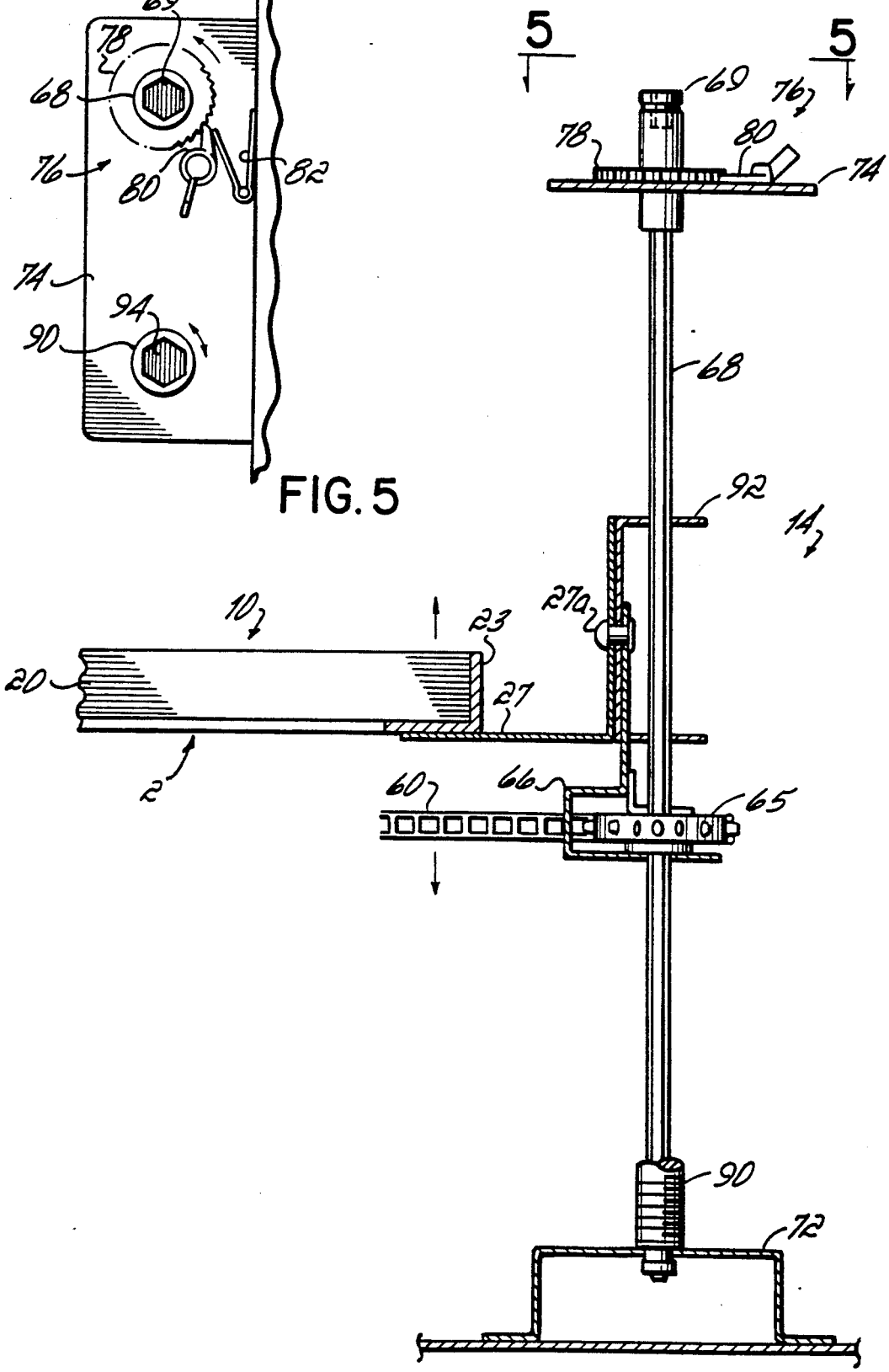
FIG. 4 is an enlarged side elevational view of the lift frame operating mechanism of FIGS. 1-3.
FIG. 5 is a view taken along lines 5—5 of FIG. 4 and illustrating the lift frame ratchet locking mechanism.

The actuating rod 56 is caused to be moved by the lift frame operating mechanism 14. With reference to FIGS. 1, 2 and 4, the lift frame operating mechanism 14 may best be visualized. The actuating rod 56 is driven by an endless chain 60 connected to the rod 56 via a bracket 61. The endless chain 60 travels around a sprocket 64 which is rotatably secured to the underneath side of the transverse support 25 of the bed frame 10, and a drive sprocket 65 housed within a drive sprocket bracket 66 (FIG. 4) which itself is secured to the bed support bracket 27 as by rivet 27*a*. Drive sprocket 65 is driven by a splined shaft 68 which includes, at its upper end 69, a hex socket for inserting a hex head wrench to rotate same. Of course, drive sprocket 65 is complementarily splined so as to mesh with splined shaft 68. However, it will be appreciated that such connection is sufficiently loose such that drive sprocket 65 may move vertically up and down splined shaft 68 as the bed frame 10 is adjusted vertically via the bed frame lift drive assembly 16, the operation of which will be described subsequently. The lower and upper ends of the splined shaft 68 are rotatably mounted within a lower mounting bracket 72 secured to the base of the casket shell 1 and an upper mounting plate 74 secured to an endwall of the casket shell 1, respectively.

With reference to FIG. 5, there is illustrated a conventional ratchet and pawl locking assembly 76 which is utilized to maintain the lift frame assembly 12 in the desired position. The locking assembly 76 includes a ratchet 78 press fitted onto the end of the splined shaft 68, and a pivoting pawl 80 which engages with the teeth of the ratchet 78. To maintain the pawl 80 normally engaged with the sprocket 78 a spring 82 forces the pawl against the ratchet 78, preventing rotation of the splined shaft 68 and hence movement of the lift frame assembly 12 in a downward direction.

To move the entire bed frame 10 vertically a pair of bed frame lift drive assemblies 16 are employed at either end of the bed frame assembly 2. Each assembly 16 comprises a threaded rod 90 which, like the splined shaft 68 of the lift frame operating mechanism 14, has lower and upper ends rotatably mounted in the lower mounting bracket 72 and upper mounting plate 74 respectively. A generally C-shaped bracket 92 is secured to each bed support bracket 26 and 27 and has threaded holes in upper and lower sides thereof which mate with the threads of the threaded rod 90. Threaded rod 90 includes in its upper end a hex socket 94 for inserting a hex end wrench for rotating the rod 90.

In use, the bed frame 10 is adjusted vertically to the desired height by rotating the threaded rods 90 at 94 with a hex end wrench. The lift frame assembly 12 is then adjusted by disengaging pawl 80 from ratchet 78 and rotating the splined shaft 68 with a hex end wrench at 69. Rotation of the shaft 6 causes rotation of drive sprocket 65, translating the chain 60 and thus the actuating rod 56, thereby causing the lift frame 12 to either rise or lower, depending on the direction in which shaft 68 is turned. Upon reaching the desired position of lift frame assembly 12, the ratchet and pawl locking assembly 76 prevents the lift frame assembly 12 from moving further.

Figure 8:
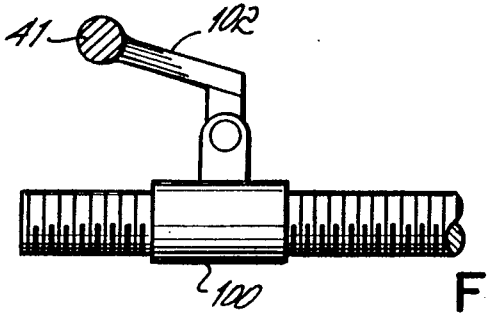
FIG. 8 is an enlarged side elevational view of the connection between the lift frame operating mechanism and lift frame of the embodiment of the present invention of FIG. 6.
Figure 7:
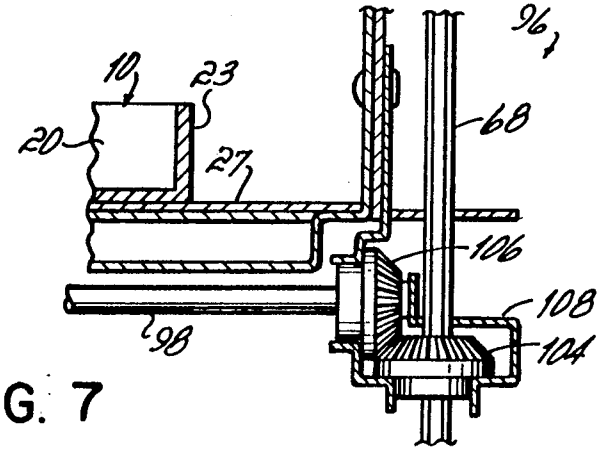
FIG. 7 is an enlarged side elevational view of the lift frame operating mechanism of the embodiment of the present invention of FIG. 6.

Referring now to FIGS. 6-8, and with like numbers representing like components, there is illustrated an alternative embodiment of the present invention. In this embodiment, an alternative version of the lift frame operating mechanism 96 is disclosed Instead of utilizing a chain driven actuating rod this mechanism 96 includes a bevel gear driven threaded rod 98 the end of which is threaded through an acme nut 100 which is connected to a yoke 102. The yoke 102 is connected to the free side 41 of lift frame 31. As in the previous embodiment, splined shaft 68 is utilized to actuate the lift frame assembly 12. However, a pair of bevel or miter gears are utilized to transfer the torque of the splined shaft 68 about a vertical axis into torque of the threaded actuator rod 98 about a horizontal axis. To do so, bevel or miter gears 104 and 106 are encased within a gear box 108 which itself is fixedly secured to the C bracket 92. It will therefore be appreciated that vertical translation of the bed frame 10 will effect vertical translation of the gear box 108 and hence gears 104 and 106, the gear 104 being complementarily splined to the splined shaft 68 such that a sufficient bearing surface is provided to transfer torque while a sufficient clearance is maintained such that gear 104 may translate along shaft 68. Gear 106 is press fitted on the end of shaft 98 so as to transmit torque thereto.

In operation of this embodiment of the present invention, shaft 68 is rotated at 69 with use of a hex head or other suitable drive head wrench. Gear 104 is thereby rotated, causing gear 106 to rotate as well. Rotation of gear 106 causes the threaded rod 98 to rotate and, depending on the direction of rotation of the shaft 68, causes the nut 100 to traverse the threaded rod 98 and causing the lift frame 12 to either rise or lower. In this embodiment, the locking assembly 76 of the former embodiment is not required, as the pitch of the threads of the rod 98 and nut 100 are selected so that the nut 100 is self-locking, i.e., the nut cannot convert horizontal load generated by deceased 3 atop the lift frame assembly 12 into rotation of rod 98.

With reference to FIG. 9, again with like numbers representing like components, there is illustrated another alternative embodiment of the present invention. In this embodiment, an air inflatable bladder or device 110 is employed which is approximately 6–10" wide and has a length corresponding to the width of the bed frame 10. The bladder 110 is placed upon a rigid surface, such as a plate 112 which resides within the bed frame 10. The bladder 110 is secured to the plate 112 by any suitable means, such as Velcro strips, string or fabric A bulb-type pump 114 with check valve 116 and relief valve 118 are provided for inflating the device 110; other suitable pump means incorporating both check and relief valves may be utilized and may be either hand or foot operated. Squeezing bulb 114 forces air into the device 110 and check valve 116 allows air to enter but not to exit the interior of the bladder 110. A relief valve 118 may be employed for bleeding air from the bladder 110. Repeated strokes of the bulb pump 114 inflates the bladder 110 to, preferably, a height of approximately 4–6". This action serves to raise the thoracic area of a deceased to the desired height. Of course, releasing air via the release valve 118 allows for precise adjustment of a deceased to any degree. The bladder 110 may readily be concealed, such as by sewing inside a mattress 119, and is constructed of sturdy flexible non-porous material such as coated fabrics, reinforced rubber, urethane coated nylon fabric, or unreinforced thermoplastic or elastomeric materials. While adequate pressures may be generated with the bulb pump 114 to raise the weight of a deceased, it will be appreciated that many other methods of inflation may be employed, such as compressed gas, foam, liquids, air compressors, etc.

Various other areas of a deceased may be raised with the bladder 110. For example, the bladder 110 can be placed in the lumbar area of a decreased and inflated to create the desired appearance. In addition, the bladder 110 may be used in conjunction with various pillows, etc. to obtain the desired attitude of a deceased.

Figure 10:
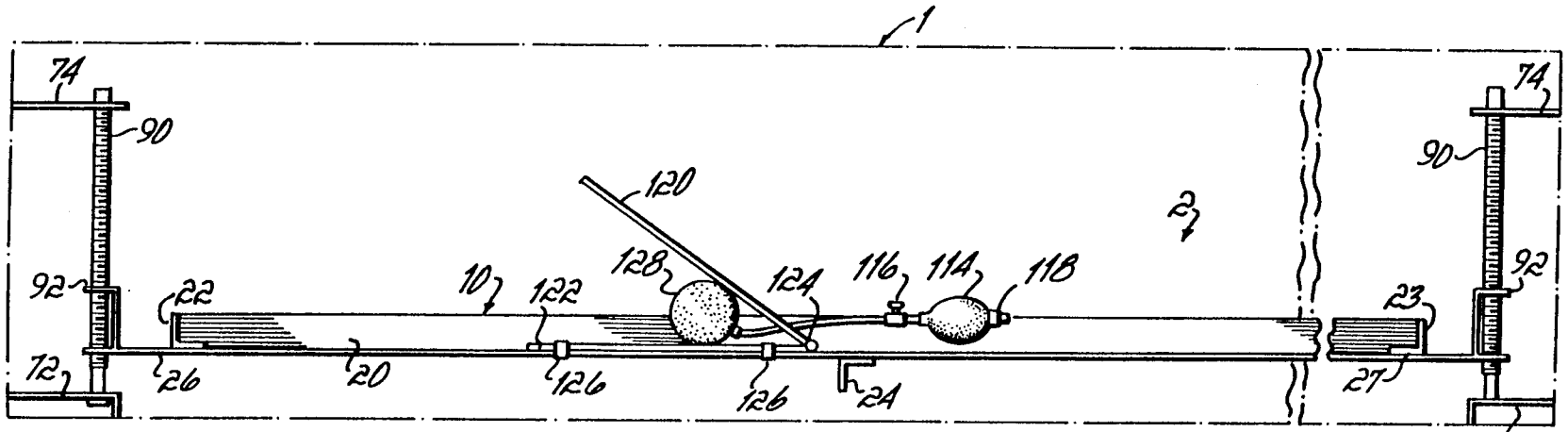
FIG. 10 is a view similar to FIG. 9 but illustrating yet another alternative embodiment of the present invention.

Yet another alternative embodiment of the present invention is illustrated in FIG. 10. In this embodiment, a hinged frame having plate-like sides or members 120 and 122 is placed within the bed frame 10. The plates are hinged along their coextensive edges at 124, and are oriented such that the open end of the hinged frame faces toward the head end of the bed and is located approximately 17" from the head of the bed. Numerous materials may be selected for the plates 120, 122, such as plywood, aluminum, plastic, etc., along with any known conventional hinge mechanism. Fasteners 126 secure the lowermost hinged plate 122 within the bed frame 10 along bed frame sides 20 and 21. An inflatable bladder 128 is positioned between the plates 120 and 122 and is preferably secured to the lowermost plate 122. The inflatable bladder 128 is initially flat and when inflated tends to become round. By selecting the proper width of the bladder 128 in the flat uninflated state a lift height of approximately 4½ can be attained. For example, the width of the bladder 110 in the uninflated state is approximately equal to one-half the circumference of the cross section of the bladder inflated into a circle. And since the circumference of the inflated bladder in cross-section is equal to pi multiplied by the diameter of the inflated bladder, the width of any desired diameter can be computed as one-half pi multiplied by the desired diameter As in the prior embodiment, the bladder 128 is provided with a check valve 116 and a relief valve 118 for pumping air into and relieving air from the bladder 128, respectively.

Figure 11:
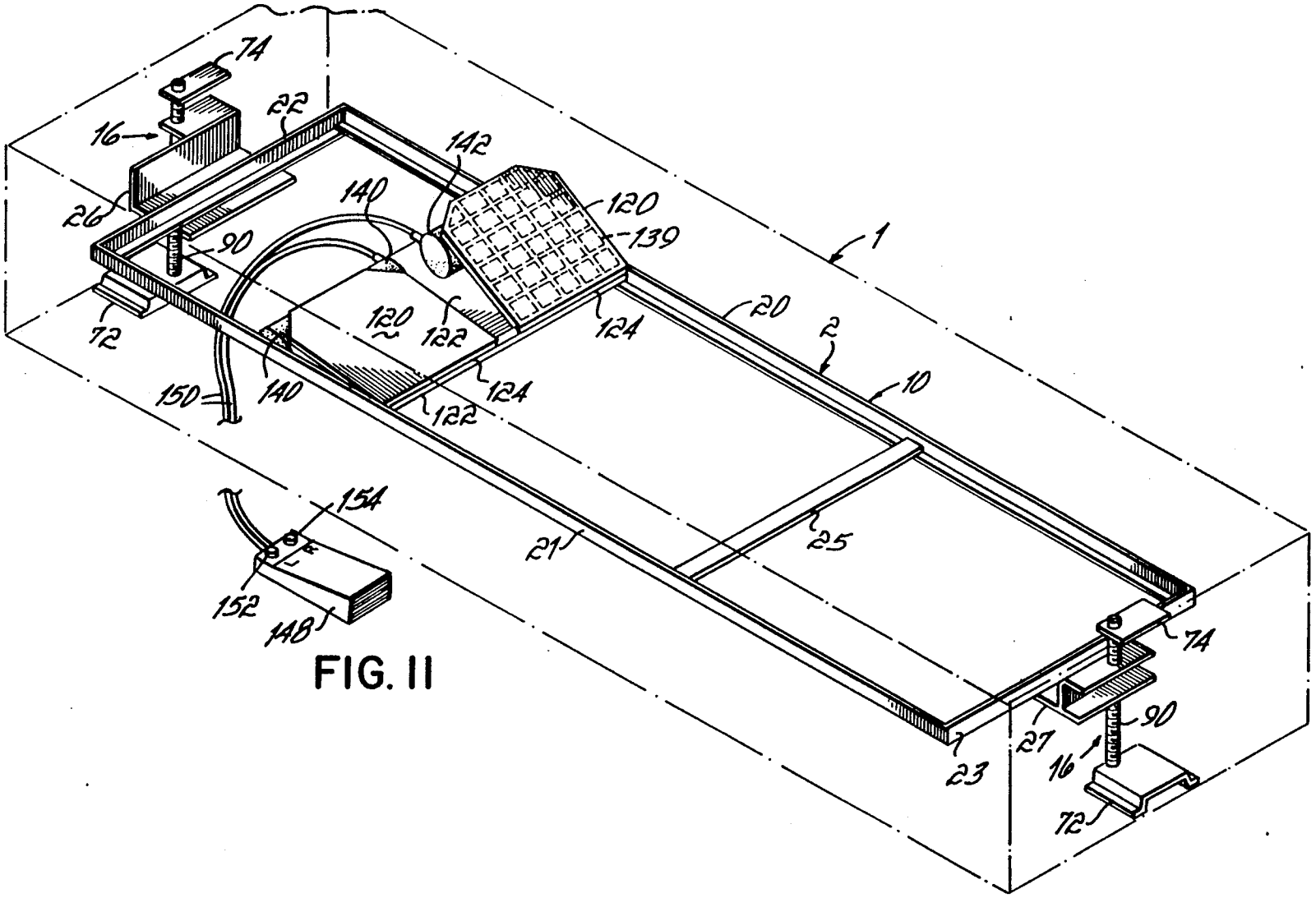
FIG. 11 is a perspective view of still another embodiment of the present invention.

With reference to FIG. 11 there is illustrated still another embodiment of the present invention. In this embodiment, a pair of hinged frames similar to that of the embodiment illustrated in FIG. 10 are positioned transversely across the width of the bed frame 10. Each hinged frame includes an upper plate-like side or member 120 and a lower plate-like side or member 122. The plates are hinged along their coextensive edges at 124 and are similarly oriented with respect to the FIG. 10 embodiment such that the open ends of the hinged frames face toward the head end of the bed and are located approximately 17" from the head of the bed. As previously described, numerous materials may be selected for the plates 120 and 122, such as plywood, aluminum, plastic, etc., along with any known conventional hinge mechanism. A preferable method of constructing the plate members is to employ a thin plate or sheet with numerous transverse and longitudinal ribs (indicated by phantom lines 139) attached to the underside thereof to form a light weight yet very stiff "egg crate" type of structure. A preferable material for the plate members is a stiff thermoplastic or thermoset material such as talc filled polypropylene.

Two individual elongated inflatable bladders 140 and 142 are placed between the upper and lower members of the left hinged frame and right hinged frame respectively. A foot operated pump 148 is connected to both of the bladders 140 and 142 with identical hoses or supply lines 150. The pump 148 includes separate pressure relief valves 152 and 154 which correspond to the left bladder 140 and the right bladder 142 respectively.

In use, this embodiment is operable to raise the thoracic area of a deceased as in the previous embodiments, but in addition, is operable to rotate the thoracic area of a deceased about a longitudinal axis of the bed frame 10. To do so, the foot pump 148 is operated to inflate both the bladders 140 and 142 simultaneously and substantially evenly. Repeated strokes of the pump 148 raise the upper plate members 120, 120 as the bladders 140, 142 become inflated. After repeated strokes of the pump 148 to achieve the desired height of the upper plate members 120, 120, the bleed valves 152, 154 may be operated to lower one or the other of the plate members 120 to effect rotation of the thoracic area of the deceased. For example, should the operator wish to lower the left side of a deceased relative to its right side, the left bleed valve 152 is depressed to bleed air from its bladder 140 thereby lowering the left upper plate member 120. To rotate the thoracic area of the deceased to the right, the same procedure is followed utilizing the right bleed valve 154. As in the previous embodiment, fasteners are utilized to secure the lowermost hinged plates 122, 122 within the bed frame 10 along bed frame sides 20 and 21.

Numerous variations and modifications will be appreciated by those skilled in the art which will result in an improved adjustable casket bed frame assembly, yet all of which will be within the spirit and scope of the invention. Accordingly, the invention is not to be limited except by the appended claims.

What is claimed is:

1. A casket bed comprising:

a planar rigid bed frame, and adjustable means mounted on said bed frame for engaging the back of a corpse to raise its thoracic area and to produce a more natural and serene appearance, without losing the plane of the bed as a baseline.

2. A casket comprising:

a shell, a planar rigid bed frame, means for mounting said bed frame in said shell, said mounting means including means for raising and lowering at least one end of said frame, and adjustable means mounted on said bed frame for engaging the back of a corpse to raise its thoracic area and to produce a more natural and serene appearance, without losing the plane of the bed as a baseline.

3. A casket bed as in claim 1 in which said adjustable means comprises:

first and second support frames having abutting edges and remote edges, said abutting edges being hinged together, the remote edge of said first frame being pivoted to said bed frame, the remote edge of said second frame being slidable with respect to said bed frame, and means for sliding said edge of said second frame toward said edge of said first frame to cause the hinged edges of said frames to rise.

4. A casket bed comprising:

a planar rigid bed frame, and adjustable means mounted on said bed frame for engaging the back of a corpse to raise its thoracic area and to produce a more natural and serene appearance, said adjustable means comprising:

first and second support frames having abutting edges and remote edges, said abutting edges being hinged together, the remote edge of said first frame being pivoted to said bed frame, the remote edge of said second frame being slidable with respect to said bed frame, and means for sliding said edge of said second frame toward said edge of said first frame to cause the hinged edges of said frames to rise; said sliding means comprising:

an endless chain lying in a horizontal plane under said bed frame, and connected to said slidable edge, a first sprocket carrying said chain and rotatably mounted to said frame intermediate the ends of said frame, a second sprocket carrying said chain and rotatably mounted to said bed frame, and means for rotating said second sprocket to move said chain, thus sliding said slidable edge and raising said hinged edges, whereby said bed can be raised while maintaining the operability of said adjusting means.

5. A casket bed as in claim 4 in which said sprocket rotating means comprises:

a vertical splined shaft rotatably mounted in said shell, said second sprocket being vertically slidable on said shaft and rotatable with said shaft, and a ratchet and pawl to hold said shaft against rotation in a direction that would drop said hinged edges after they have been raised.

6. A casket bed as in claim 3 in which said adjustable means comprises:

a rod extending longitudinally under said bed frame, said rod having a threaded end underlying said slidable edge of said frame, an internally threaded nut on said rod, said nut being connected to said slidable edge and being axially movable to slide said edge when said rod is rotated, and means for rotating said rod.

7. A casket bed comprising:

a planar rigid bed frame, and adjustable means mounted on said bed frame for engaging the back of a corpse to raise its thoracic area and to produce a more natural and serene appearance, said adjustable means comprising:

first and second support frames having abutting edges and remote edges, said abutting edges being hinged together, the remote edge of said first frame being pivoted to said bed frame, the remote edge of said second frame being slidable with respect to said bed frame, and means for sliding said edge of said second frame toward said edge of said first frame to cause the hinged edges of said frames to rise;

said sliding means comprising:

a rod extending longitudinally under said bed frame, said rod having a threaded end underlying said slidable edge of said frame, an internally threaded nut on said rod, said nut being connected to said slidable edge and being axially movable to slide said edge when said rod is rotated, and means for rotating said rod;

said rod rotating means comprising:

a pair of engaged mitered gears assembled in a gear box, a vertical splined shaft passing through said gear box, one of said gears having a horizontal axis and being fixed to said rod, the other of said gears having a vertical axis and being vertically slidably mounted on said splined shaft while being rotatable with it, whereby said bed can be raised while maintaining the operability of said adjusting means.

8. A casket bed as in claim 1 in which said adjustable means comprises:

at least one elongated bladder mounted on the upper surface of said bed frame, and means for inflating said bladder.

9. A casket bed as in claim 1 further comprising a mattress of said bed frame, said bladder being sewn inside said mattress.

10. A casket bed as in claim 1 in which said adjustable means comprises:

a hinged frame mounted on said bed frame, said hinged frame having a first upper member and a second lower member, an inflatable bladder disposed between said members, and means for inflating said bladder, whereupon inflation of said bladder raises said first upper member.

11. A casket bed comprising:

a planar rigid bed frame, and adjustable means mounted on said bed frame for engaging the back of a corpse and being operable to raise its thoracic area and rotate its thoracic area about a longitudinal axis of said bed frame to produce a more natural and serene appearance, without losing the plane of the bed as a baseline.

12. A casket comprising:

a shell, a planar rigid bed frame, means mounting said bed frame in said shell, said mounting means including means for raising and lowering at least one end of said frame, and adjustable means mounted on said bed frame for engaging the back of a corpse and being operable to raise its thoracic area and rotate its thoracic area about a longitudinal axis of said bed frame to produce a more natural and serene appearance, without losing the plane of the bed as a baseline.

13. A casket bed as in claim 11 in which said adjustable means comprises:

a pair of hinged frames mounted on said bed frame, each said hinged frame having a first upper member and a second lower member, said pair of hinged frames being positioned transversely across said bed frame, inflatable bladder means disposed between said first and second members of said hinged frames, and means for inflating said bladder means, whereupon inflation of said bladder means is operable to raise each said first upper member of each said hinged frame, said first upper members being raisable to differing heights as desired.

* * * * *